US005211339A

United States Patent [19]

Zeiler

[11] Patent Number: 5,211,339

[45] Date of Patent: May 18, 1993

[54] APPARATUS FOR DISPERSING AND DIRECTING DYE ONTO A SUBSTRATE

[75] Inventor: Bernhard Zeiler, Spartanburg, S.C.

[73] Assignee: Milliken Research Corporation, Spartanburg, S.C.

[21] Appl. No.: 898,232

[22] Filed: Jun. 12, 1992

Related U.S. Application Data

[63] Continuation of Ser. No. 539,776, Jun. 18, 1990, abandoned.

[51] Int. Cl.[5] ..... B05B 17/04

[52] U.S. Cl. ..... 239/295; 239/124; 239/461; 137/825; 68/205 R; 118/326

[58] Field of Search ..... 68/205 R; 137/825; 118/325, 326, 679, 698; 239/99, 124, 290, 295, 461, 543, 544, 554, 555, 602, 434, 418

[56] References Cited

U.S. PATENT DOCUMENTS

| | | | |
|---|---|---|---|
| 1,841,452 | 1/1932 | Ranger | 346/75 |
| 3,443,878 | 5/1969 | Weber et al. | 68/183 |
| 3,570,275 | 3/1971 | Weber et al. | 68/205 R |
| 3,614,880 | 10/1971 | Bayne et al. | 68/205 R |
| 3,942,343 | 3/1976 | Klein | 68/205 R |
| 3,969,779 | 7/1976 | Stewart, Jr. | 8/149 |
| 4,034,584 | 7/1977 | Klein et al. | 68/205 R |
| 4,290,982 | 9/1981 | Bauman | 239/555 |
| 4,501,038 | 2/1985 | Otting | 8/151 |
| 4,584,854 | 4/1986 | King | 68/205 R |
| 4,700,894 | 10/1987 | Grzych | 239/555 |
| 4,783,977 | 11/1988 | Gilpatrick | 68/205 R |
| 4,828,174 | 5/1989 | Love, III | 239/11 |
| 4,923,743 | 5/1990 | Stewart, Jr. | 68/205 R |
| 4,934,008 | 6/1990 | McBride | 8/149 |

*Primary Examiner*—Gregory L. Huson
*Assistant Examiner*—Christopher G. Trainor
*Attorney, Agent, or Firm*—Kevin M. Kercher; Terry T. Moyer

[57] ABSTRACT

An improved apparatus is disclosed for spraying a liquid marking material onto the surface of a substrate by dividing a stream of the marking material into droplets by an impinging stream of pressurized control fluid directed at the surface to be sprayed. The apparatus comprises a module forming a plurality of first conduits for delivery of the stream of marking material and a plurality of second conduits for delivery of the impinging stream of control fluid. In one embodiment, the module comprises a module body having a plurality of first grooves and a plurality of second grooves and means for enclosing such grooves to form the first and second conduits, respectively. Methods of producing substrates having a sprayed pattern are also disclosed which employ such apparatus.

30 Claims, 6 Drawing Sheets

APPARATUS FOR DISPERSING AND DIRECTING DYE ONTO A SUBSTRATE

This application is a continuation of Ser. No. 07/539,776, filed Jun. 18, 1990, now abandoned.

FIELD OF THE INVENTION

The present invention is directed to apparatus for impressing marking materials (e.g., dyes, inks, paints, coatings) onto substrates (e.g., fabric) and, more particularly, to a mechanism for producing a plurality of aligned streams of atomized droplets to produce a dye pattern on a substrate.

BACKGROUND OF THE INVENTION

It is known to apply liquid dyes to moving substrates, particularly textile materials, from a plurality of streams which are directed onto such materials and selectively controlled to produce a pattern thereon. It is also known, in connection with such methods and apparatus, to use a control fluid, commonly air, as the means by which flow of liquid dye is controlled. While various techniques for control have been used, the control fluid methods commonly employ one of the following approaches.

In a first approach (see e.g., U.S. Pat. Nos. 3.985,006, 3,969,779 and 4,095,444), a stream of marking material is directed at the desired substrate and a transverse stream of a control fluid is used to divert the marking material stream into a barrier or the like, in response to externally supplied dyeing pattern information.

In a second approach (see e.g., U.S. Pat. Nos. 3,443,878 and 3,570,275), a curtain of marking material is directed in closely spaced, parallel relation to the desired substrate, and one or more streams of a control fluid are directed through the curtain in the direction of the substrate, thereby causing displacement of marking material from the curtain onto the substrate.

In a third approach (see e.g., U.S. Pat. No. 4,501,038), a stream of a control fluid such as air is directed into a mixing chamber in which a quantity of marking material is introduced in accordance with pattern information. The chamber may be positioned in close proximity to the desired substrate, and may be configured so that, for example, air enters the chamber from the top, intersects a flow of marking material entering the chamber from the side, and causes a spray of air and marking material to exit from the confines of the chamber, via a conduit extending from the bottom of the chamber, onto the desired substrate.

Although these apparatus have shown limited utility for the production of products with fairly regular dyeing patterns, they have proven inadequate to produce more "complex" patterned products of two basic categories. The first may be called a "diffuse pattern" product, in which the desired substrate has been marked or dyed in a pattern which exhibits soft, diffused color boundaries and perhaps exhibits color areas which overlap and blend almost imperceptibly from one to another, and which product may exhibit literally dozens or hundreds of different colors, shades, or hues over the pattern area. The second category may be called a "random pattern" product, in which the distribution of color within areas on the substrate has a random or pseudo random appearance. The color may be in the form of extremely small flecks or specks, or may be in the form of larger areas having irregular, random appearing borders. Some products exhibit characteristics which are a combination of these two categories, wherein, for example, irregularly shaped patches of color exhibit diffused boundaries and contain a multitude of varying shades or hues, and which may contain randomly distributed and/or overlapping specks of color in localized areas of the substrate.

Coassigned U.S. Pat. No. 4,923,743, entitled Apparatus and Method for Spraying Moving Substrates, discloses a unique apparatus that will produce such "complex" patterned products. Therein several arrays of closely spaced streams of marking material are normally directed into corresponding collection surfaces or receptacles. Each stream in a given array has associated with it a source of pressurized air or other control fluid which, on command, forms and directs an atomizing control fluid stream into contact with the marking material whereby the stream of marking material is transformed into a mist of variously sized diverging droplets which are propelled in the direction of the substrate to be marked. By interrupting the streams of atomizing fluid in oscillatory fashion, uniform reproduction of various solid color or multi-hued patterns is possible. By employing such controlled pulsations, the marking material sources, directing fluid sources, substrate, droplet size distribution and the degree of droplet dispersion can be carefully controlled, yielding intricate patterns possessing great subtlety, delicacy, and variety which may be produced with a high degree of reproducibility. By providing for the nonsimultaneous actuation of adjacent atomizing fluid streams along a given array, a wide variety of side to side or fill direction patterns may be produced.

In prior art apparatus, the conduits and orifices for delivery of the marking material have been fashioned separately from the conduits and orifices for delivery of the air (control fluid) stream. The separate components were then assembled in the desired configuration by mounting them in a holder along with other pairs of separate components to form an array of marking material/control fluid orifice combinations. For the machine to operate optimally, each orifice combination in the array must deliver exactly the same amount of marking material onto the substrate as its neighbor over the entire width of the substrate. Due to manufacturing tolerances in the conduits, orifices and the holder, the resulting tolerance build up of the components over the entire array was large enough to effect a variation in the geometry of the assembled components. This variation in geometry adversely affected the flow rate of the marking material and control fluid, the directivity of the marking fluid and control fluid, and the amount of aspiration induced pressure drop seen across marking material orifices. This in turn could produce a variation in marking material flow onto the substrate target area, creating streaks on the substrate.

The individual dye nozzles can be retracted from the air stream to eliminate aspiration, and the various components are or can be arranged for manual alignment. However, such an arrangement has proved to be labor intensive because of the number of component combinations involved (sometimes as many as 573 or 2000 combinations per machine) and the trial and error nature of the adjustments. Such an alignment procedure is not efficient or economical in the production environment. Additionally, because of the long length of the marking material conduit and because the conduit had a single exit orifice, a solid contaminant, once in the conduit would clog the orifice and would be difficult to remove.

The invention described herein provides a mechanism whereby the geometry of the air and dye conduits and orifices is maintained to minimize or eliminate variation in dye flow rate and directivity to the substrate without the need to employ complex and inefficient alignment procedures. With this mechanism aspiration of dye is permanently eliminated from the process and whereby solid contaminants can be more easily removed from the marking material conduit. Other features are set out in the Summary of Invention below.

SUMMARY OF THE INVENTION

In accordance with the present invention, an apparatus is disclosed for spraying a liquid marking material onto the surface of a substrate. For this purpose a stream of the marking material is divided into droplets by an impinging stream of pressurized control fluid directed at the surface to be sprayed. The apparatus comprises a module forming a plurality of conduits for delivery of the stream of marking material and another plurality of conduits for delivery of the impinging stream of control fluid. The conduits can be formed within a single piece module, from separate pieces, by covered and enclosed grooves, or it can be formed directly into the single piece by precision locating, sizing and orienting a hole, or by other means. In one embodiment, the module is a unitary structure or body having a plurality of enclosed grooves corresponding to the conduits mentioned above. The module can be formed from stainless steel or other materials such as plastics, brass, or any other corrosion resistent material. The material employed should be capable of being machined to form the grooves and other elements needed to facilitate delivery of the various fluids. Manufacture of the modules should not be limited to machining, as precision reaction injection molding should be able to provide precise and uniform marking material and control fluid conduits as well as highly accurate and uniform alignment between the conduits that make up the pairs.

The module also includes a trough or cavity for holding marking material for delivery. A supply system provides pressurized marking material to the trough, ultimately for delivery through the module for spraying.

The grooves can be enclosed by any covering which will form the necessary conduits for marking material and control fluid delivery. In one embodiment, the grooves are enclosed by respective upper and lower cover plates. Alternatively, both sets of grooves could be enclosed by a single structure. In some embodiments the cover plates also provide other features including channels for supplying marking material or control fluid to the respective conduits or the trough which is in communication with one end of one set of the enclosed conduits and a set of bypass conduits.

When assembled, the module contains delivery paths for marking material and control fluid. The marking material is delivered from its pressurized source to the trough which is in communication with one end of one set of the conduits. The other end of the enclosed conduits is exposed to the exterior of the module body in the form of an orifice for spraying the marking material. The trough is also in communication with one end of one set of bypass conduits. The other end of the bypass conduits is exposed to a recirculation system, these conduits allow marking material contaminants to bypass the enclosed conduits and exit the trough into a recirculation system where they are removed from the marking material through filtration. The control fluid is delivered from its pressurized source into the control fluid supply channel which is in communication with the other set of conduits. One end of each of these conduits is exposed to the exterior of the module body ending in an orifice for emitting the control fluid.

In other embodiments, the module can be constructed from a single piece of material without the need for additional covering or closing structure to form the necessary conduits. In such embodiments, the conduits are formed in the module during its manufacture by, for example, machining or casting or molding. Any module which contains a plurality of conduits which are permanently (i.e., unchanging without further manufacturing or processing of components) fixed in orientation with respect to each other is contemplated as within the scope of the present invention, regardless of its construction or means of manufacture.

The above is a brief description of certain problems with the prior art and some advantages of the invention. Other features will become apparent from the Detailed Description which follows.

FIG. *7a* shows a detail, as indicated.

Figure 5:
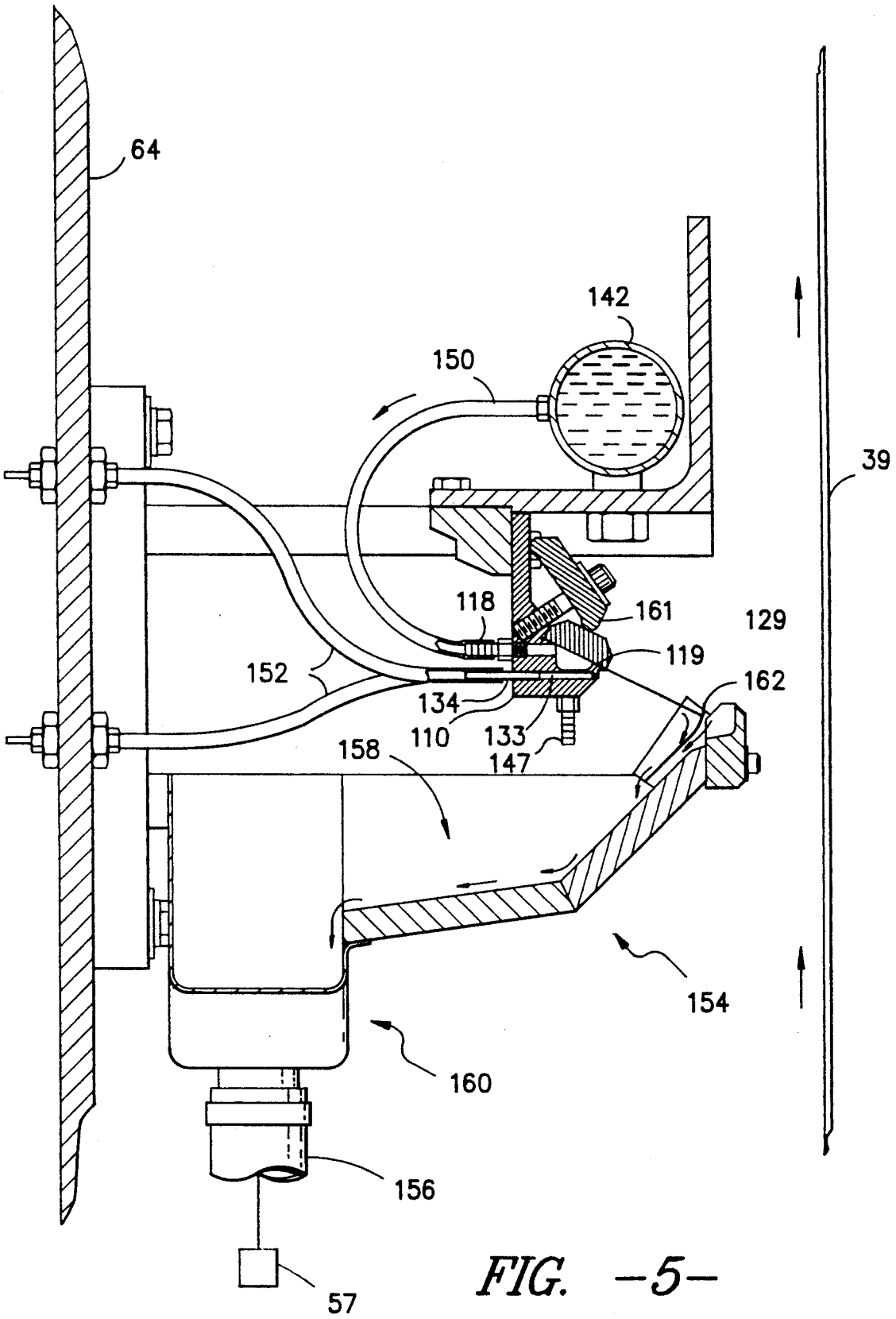
FIG. 5 is a sectional view through a module comprising a second embodiment, utilizing a single module block for both dye and air.
Figure 8:
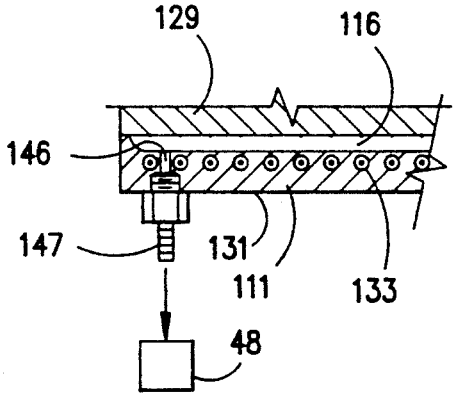
Figure 7:
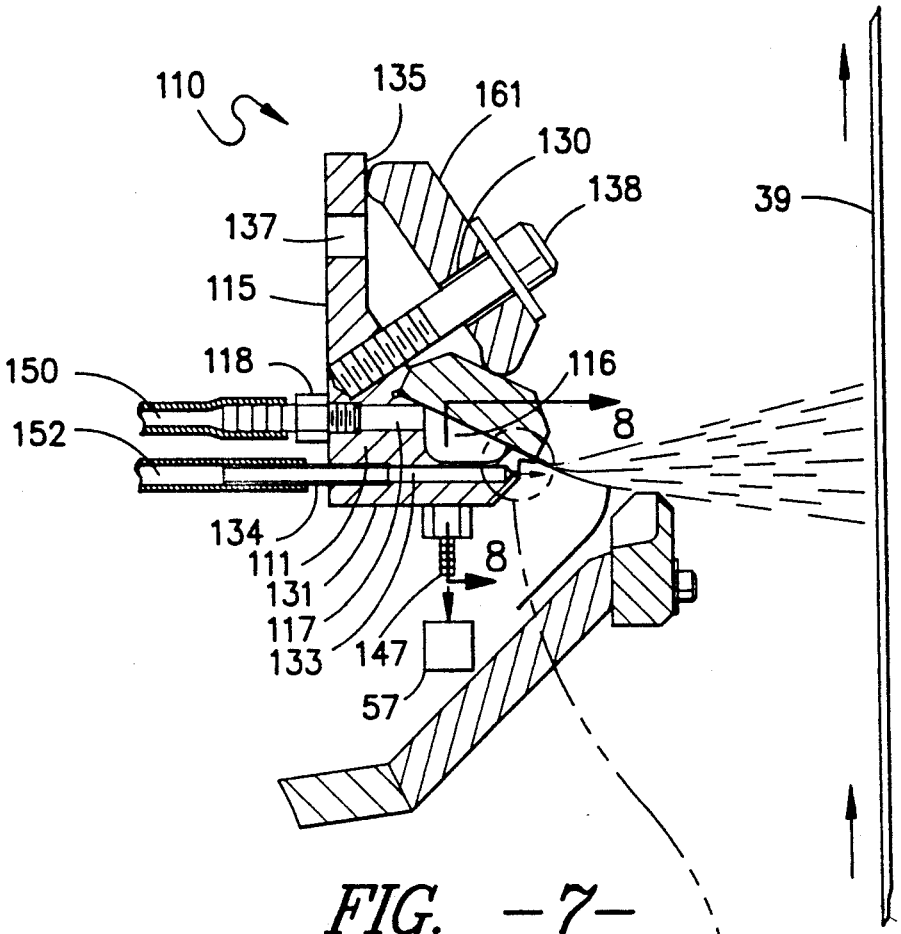
FIG. 7 is a cross-section of the embodiment of FIG. 5 taken along lines 7—7 of FIG. 6.
Figure 7A:
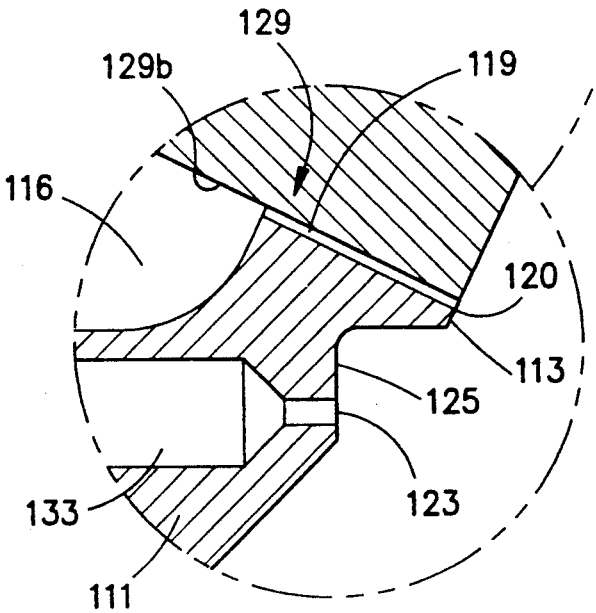

FIG. 8 is a cross-section of the embodiment of FIG. 5 taken along lines 8—8 of FIG. 7.

DETAILED DESCRIPTION

The embodiments depicted and described below in connection with FIGS. 1–8 use dye as the marking material and air as the control fluid. Although certain components are referred to with respect to air or dye, it is understood that those same components would be used for other control fluids and marking materials, respectively.

Figure 1:
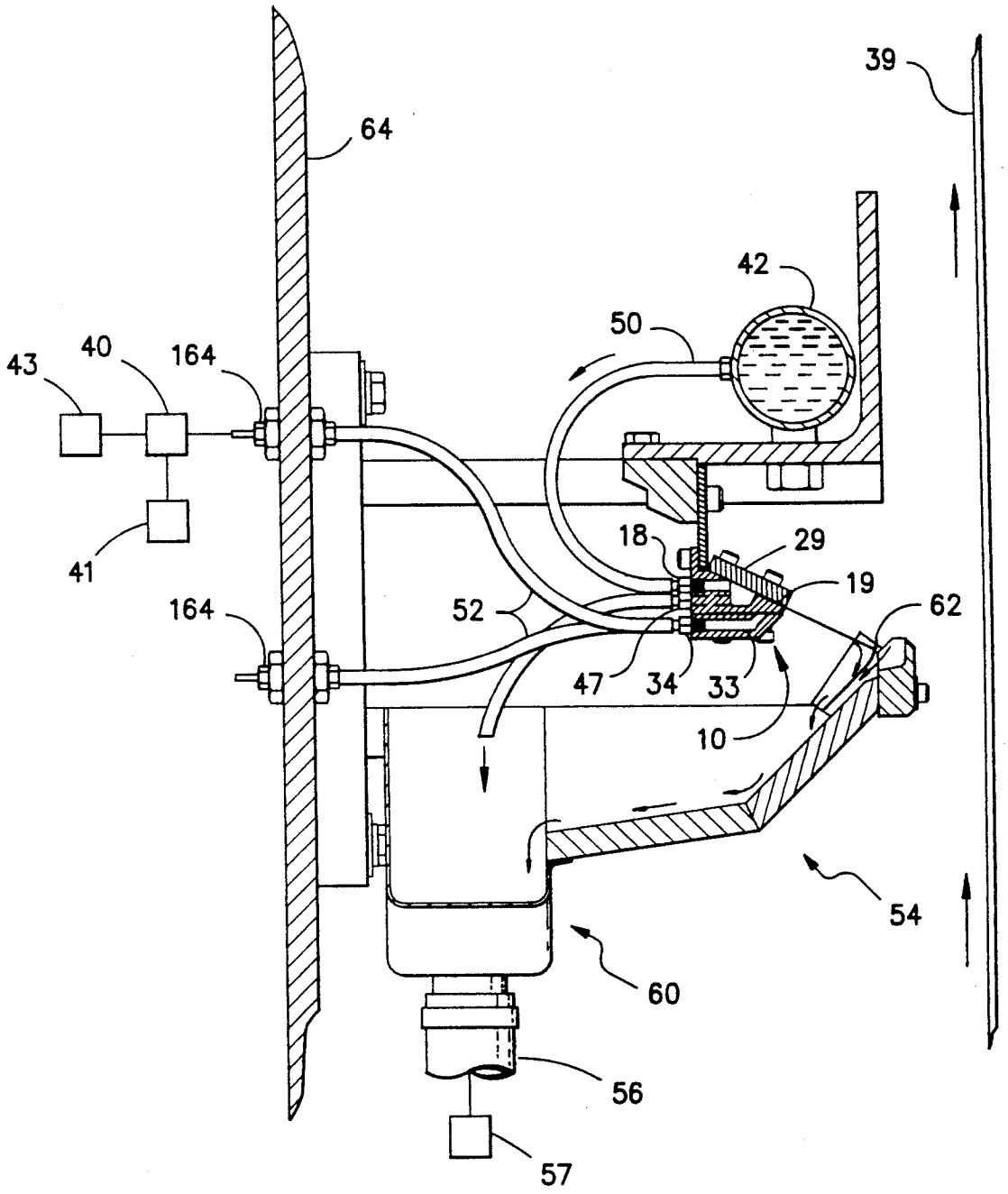
FIG. 1 is a sectional view through a module comprising a first embodiment, utilizing separate module blocks for liquid dye and air.

Before discussing the details of each embodiment, it may be helpful to discuss briefly the overall system in which various elements appear. Referring to FIG. 1 (which depicts a first embodiment), there is shown module 10 connected to a dye supply manifold 42 via external dye conduit 50. Air lines 52 at one end are connected to module 10 through fittings 34, which in turn are in fluid communication with air holes or passages 33 formed in module 10. The other ends of air lines 52 are connected to fittings 164 in front wall 64 which, via additional suitable conduits, are ultimately connected to control valve 40. Control valve 40, by way of controller 41, controls the air delivered from air source 43.

Figure 2:
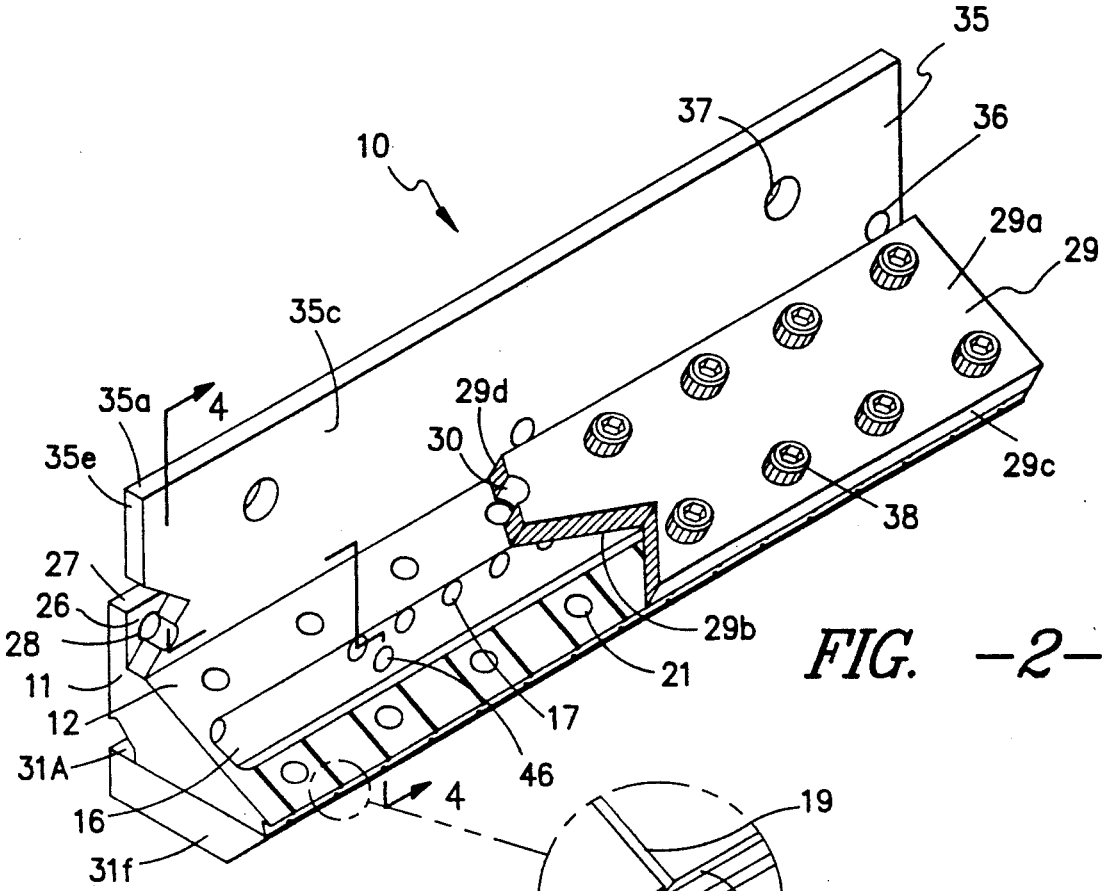
FIG. 2 depicts the embodiment of FIG. 1 in a perspective view from above with a portion removed.
Figure 2A:
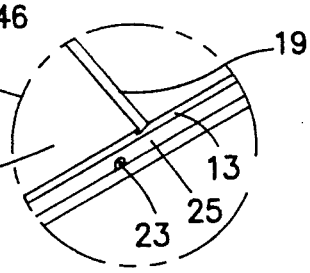
FIG. 2A shows a detail, as indicated.

A diverting lip or blade 62 is located between module 10 and moving fabric 39, in the path defined by dye grooves 19 (see FIGS. 2 and 2A). The marking material delivered under pressure from manifold 42 is directed as a dye jet toward diverting lip or blade 62. A catch trough 54 in communication with dye basin 60 is arranged in communication with the blade 62 to receive the liquid dye diverted by the blade 62 thereto. The dye collected in dye basin 60 is diverted through pipe outlet 56 back to reservoir 57 for reuse.

The exit orifices of air passages 33 are arranged to provide jets of air under pressure that intersect the dye streams and divert a portion thereof to the moving substrate 39. Controller 41 controls the delivery of air, via individual valves 40, through lines 52 according to a preselected pattern. Bursts of air according to the pattern cause droplets of dye material to impact on the substrate 39 and form the desired pattern. Other details of the apparatus are discussed below.

As can be seen in FIGS. 2 through 4A, the central component of module 10 is body 11, a wedge shaped block of stainless steel having an upper planar surface 12, front surfaces 13 and 25, a lower planar surface 14, a back surface 15, a mounting surface 26 and a top surface 27. Upper planar surface 12 forms an angle of 90° with front surface 13 and an angle of 26° with lower planar surface 14, lower planar surface 14 forms an angle of 90° with front surface 25 (see FIGS. 2, 2A and 3). A trough 16, extending generally longitudinally almost the entire length of module 10, is formed in body 11 having a depth sufficient to hold and supply dye for spraying. Trough 16 opens into the upper planar surface 12 of body 11, with the open portion extending the entire length and width of the trough.

Dye supply conduits 17 (diameter 0.159 inches) extend from the back surface 15 of body 11 into trough 16 and are fitted with dye supply fittings 18 for connection to pressurized dye manifold 42. As can best be seen in FIGS. 2 and 2A. upper planar surface 12 of body 11 has dye grooves 19 which extend from trough 16 to the dye orifices 20 on the front surface 13 of body 11, forming a path for dye flow from trough 16 to the dye orifices 20. Dye grooves 19 are longitudinally spaced along body 11 at intervals of about 0.400 inch, with each groove 19 having the same predetermined uniform cross-sectional area.

Figure 4:
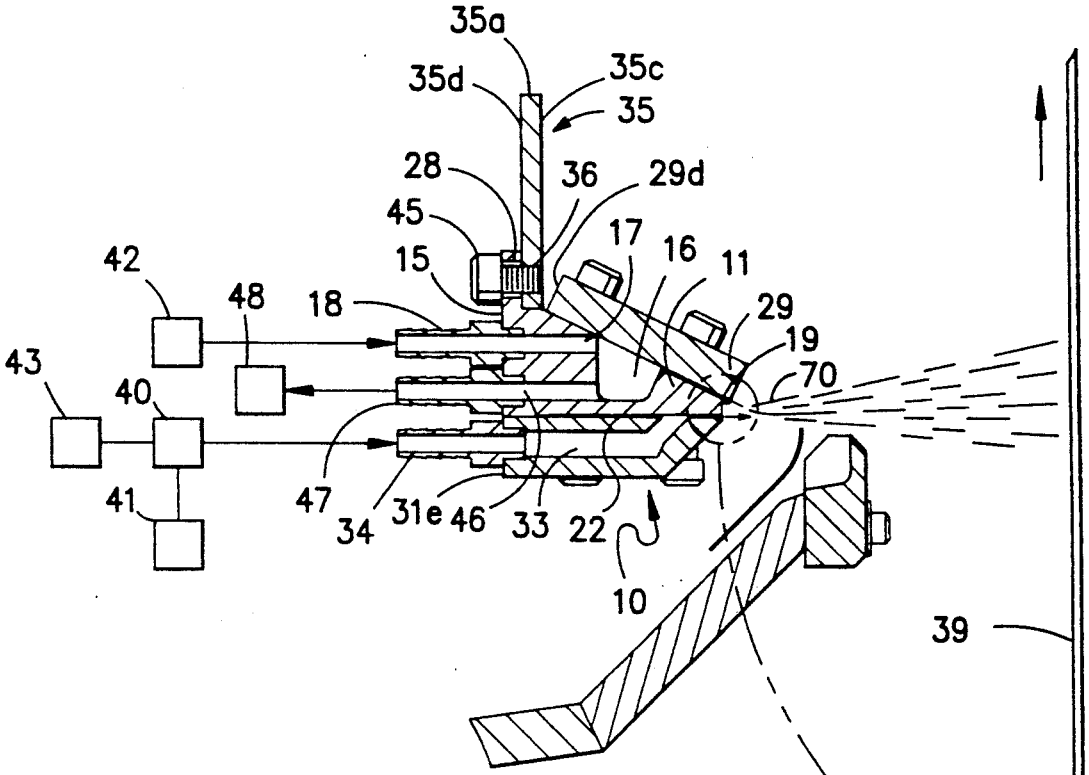
FIG. 4 is a cross section of the embodiment of FIG. 2 taken along lines 4—4.

As shown in FIG. 4, dye bypass conduits 46 (each having a diameter of 0.159 inch) extend from the trough 16 to the back surface 15 and tangent to the trough bottom, and are fitted with dye return fittings 47 for connection to a dye recirculation system 48.

Figure 3:
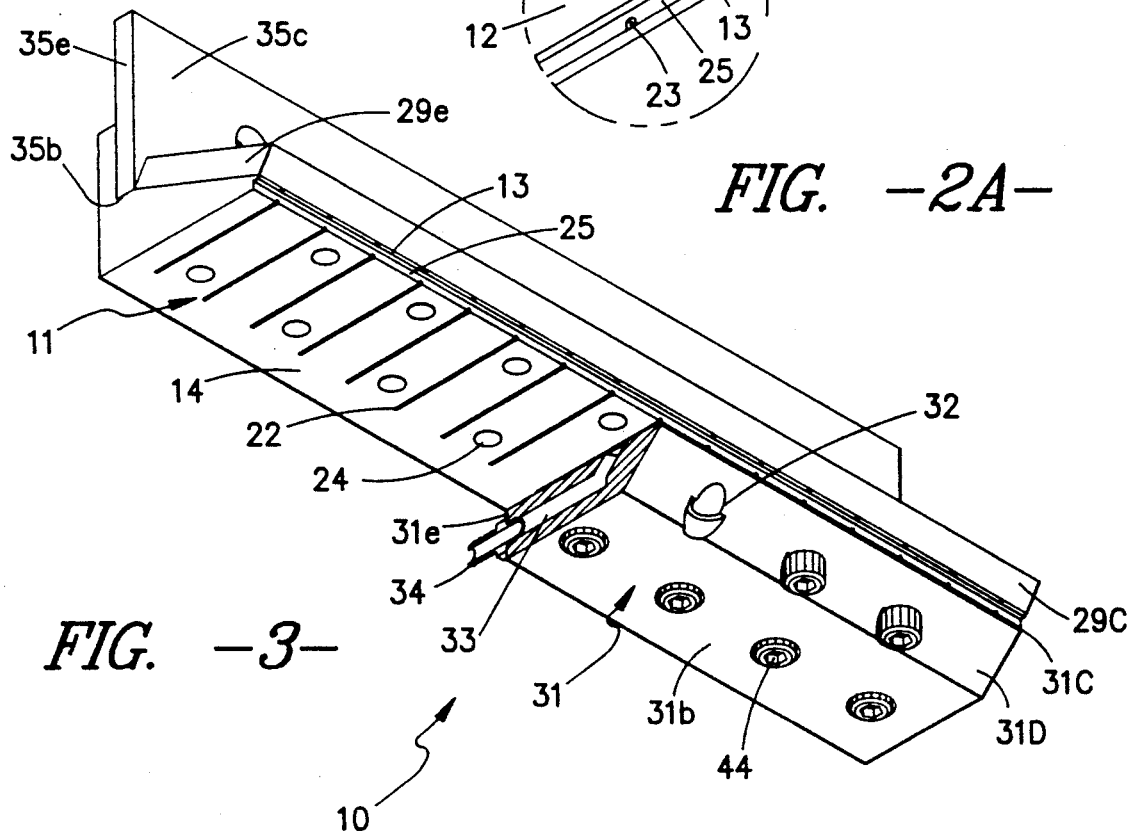
FIG. 3 depicts the embodiment of FIG. 2 in a perspective view from the bottom with a portion removed.
Figure 4A:
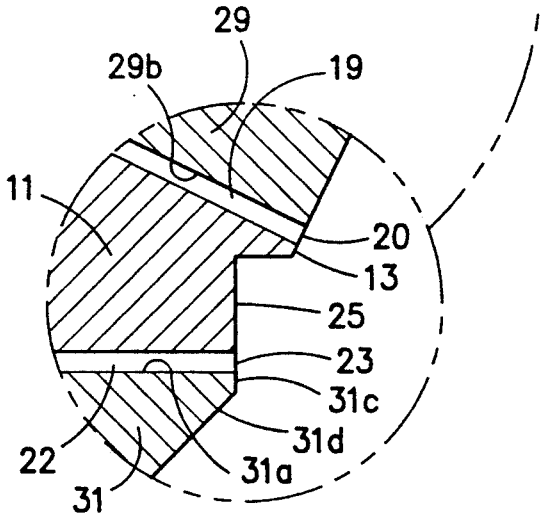
FIG. 4A shows a detail, as indicated.

Looking at FIG. 2, upper planar surface 12 of body 11 also contains threaded upper fastening holes 21 (diameter 0.164 inch) which are longitudinally spaced in two rows between alternate pairs of dye grooves 19. As best shown in FIGS. 3, 4 and 4A, the lower planar surface 14 of body 11 has air grooves 22 which extend from a point within body 11 near back surface 15 to air orifices 23 in front surface 25. Air grooves 22 are longitudinally spaced along body 11 at intervals of 0.400 inch, with each air groove 22 being paired with a corresponding dye groove 19. Both grooves lie in the same plane. Each air groove 22 has a constant radius of curvature throughout its entire length of about 0.015 inches.

Lower planar surface 14 also contains threaded lower fastening holes 24 (diameter 0.164) which are arranged in two rows. The lower fastening holes 24 in the front row are spaced longitudinally along body 11 and between alternate pairs of air grooves 22, with the first hole in the front row located between the second and third air grooves. The holes in the back row are similarly spaced, with the first hole in the back row located between the first and second air grooves.

Grooves 19 and 22 are machined on a Moore Jig Boring Machine that has guaranteed X and Y positional tolerances and squareness tolerances within 20 millionths of an inch. Two machining setups are required, one for dye grooves 19 and one for air grooves 22.

As shown in FIGS. 2A and 4A, the planar front surface 13 has dye orifices 20, and the front surface 25 has air orifices 23, for delivery of the two respective fluids from the module body 11. Air orifices 23 and dye orifices 20 are separated by approximately 0.10 inch.

As best seen in FIGS. 2, 3, and 4A, upper cover plate 29 is a rectangular block of stainless steel having planar upper, lower, front, back and side surfaces **29*a*, 29*b*, 29*c*, 29*d* and 29*e*, respectively. Bolt clearance holes 30 (diameter 0.177 inch) extend through upper cover plate 29 from the upper surface 29*a* to the lower surface 29*b* and are spaced to align with upper fastening holes 21 when assembled with body 11**.

Lower cover plate 31 is a wedge shaped block of stainless steel having planar upper, lower, protruding front, receding front, back and side surfaces **31*a*, 31*b*, 31*c*, 31*d*, 31*e*, and 31*f*, respectively. Bolt clearance holes 32 (diameter 0.177 inch) extend through lower cover plate 31 from the upper surface 31*a* to the lower surface 31*b* and receding front surface 31*d*, and are spaced to align with lower fastening holes 24 when assembled with body 11. Lower cover plate 31 contains air supply channels 33 which are fitted with air supply fittings 34 extending from the back surface 31*e* of the lower cover plate 31 to an opening on its upper surface 31*a*. Air supply channels 33 are spaced to align with each air groove 22 when assembled with body 11**.

Mounting plate 35 is a rectangular stainless steel block having planar upper lower, front, back and side surfaces **35*a*, 35*b*, 35*c*, 35*d* and 35*e*. Mounting holes 36 and 37 (having threaded diameter 0.250 inch and clearance diameter 0.281 inch, respectively) extend through mounting plate 35 from the front surface 35*c* to the back surface 35*d*. Mounting holes 36 are spaced to align with mounting clearance holes 28 when assembled with body 11. Mounting clearance holes 37 are spaced to align with appropriately threaded holes associated with mounting fixtures on the apparatus in which the module 10** is used.

The module 10 is assembled by placing the lower surface **29*b* of upper cover plate 29 onto the upper planar surface 12 of body 11 such that upper fastening holes 21 align with bolt holes 30, and such that front surface 29*c* of the upper cover plate is flush with the front surface 13. Threaded bolts 38 are then placed through bolt holes 30 and into upper fastening holes 21. Bolts 38 are tightened to produce a liquid tight seal between upper cover plate 29 and body 11**. Such seal may require use of soft metal plating or other suitable sealing techniques.

The upper surface **31*a* of lower cover plate 31 is placed onto the lower planar surface 14 of body 11 such that lower fastening holes 24 align with bolt holes 32 and air supply channels 33 align with air grooves 22, and such that the protruding front surface 31***c* is flush with front surface 25. Threaded bolts 44 are then placed through bolt holes 32 (counterbored on surfaces 31*b* and 31*d*) and into lower fastening holes 24. Bolts 44 are tightened to produce a seal between lower cover plate 31 and body 11. Threaded air supply fittings 34 are inserted into the ends of air supply channels 33 on the back surface 31*e* of lower cover plate 31. Threaded dye supply fittings 18 are inserted into the ends of dye supply conduits 17 on the back surface 15 of body 11. Finally, mounting plate 35 is attached to body 11 such that fastening holes 36 align with bolt clearance holes 28. Threaded bolts 45 are then inserted and tightened.

Once assembled, module 10 provides an array of dye conduits and air conduits for delivering dye and air through the module. The lower surface of upper cover plate 29 encloses dye grooves 19 to form covered dye conduits extending from trough 16 to dye orifice 20. The upper surface 31*a* of lower cover plate 31 encloses air grooves 22 to form air conduits which are in communication with air supply channels 33 and which end in air orifices 23.

The assembled module 10 is used to spray patterns on a substrate. The module 10 is attached through mounting holes 37 to a spraying machine, such as that disclosed in the previously referenced copending and coassigned U.S. patent application, that provides a pressurized dye source, a pressurized air source, a pressurized air source and means for selectively controlling the flow of air. The pressurized dye source, via manifold 42 and external dye conduit, is connected to dye supply fittings 18. Dye can then flow in a continuous path from the dye source, into trough 16, through the dye conduits formed by dye grooves 19 and out through dye orifices 20 and through the bypass conduits 46. The pressurized air source is connected to air supply fittings 34. When air flow is desired, air can flow in a continuous path from the air source 43, via fittings 164, air lines 52, fittings 34, air supply channels 33, through the air conduits formed by air grooves 22, and out through air orifices 23.

The operation of a spraying apparatus employing a module of the present invention can be described by considering the operation of a single air conduit/dye conduit pair and with reference to FIG. 4. A control valve 40 associated with the pressurized air source 43 prevents air from flowing to air supply fitting 34. Dye is continuously supplied by pressurized dye source 42 to dye supply fitting 18 and flows out dye orifice 20. The dye stream emanating from dye orifice 20 flows unimpeded into the surface of diverting lip or blade 62, which collects the dye in catch trough 54 for disposal or recirculation to reservoir 57.

When dye from the dye stream is to be applied to the substrate 39, pulses of air generated by the opening and closing of the control valve 40 are supplied from the pressurized air source 43 to air supply fitting 34. The air stream emanating from air orifice 23 impinges the dye stream, disrupting the regular flow of dye. As shown in the detail of FIG. 4A, the dye orifice 20 and air orifice 23 are positioned such that the dye is contacted with air after it exits from the dye orifice 20. As a result of the interaction of the higher pressure air stream (e.g. 25–40 p.s.i.g.) with the lower pressure dye stream (e.g., 2–4 p.s.i.g.) the dye stream is broken up into a spray of diverging droplets. The combined momentum of the two streams then carries the droplets to the surface of the substrate 39. Because the dye exits the dye orifice 20 outside of the airstream envelope 70, aspiration of dye from the dye supply conduit is eliminated, thereby eliminating the need to create uniform aspiration across the width of the module. To achieve the desired dying pattern, control valves for each conduit pair can be selectively opened and closed separately or in combinations according to pattern information supplied by controller 41.

Two general dye flow streams exist in trough 16. One stream (the supply stream) flows from the exit of each dye supply conduit 17 to the entrance of each dye conduit formed by dye groove 19. The second flow stream (the bypass steam) flows from the exit of each dye supply conduit 17 to the entrance of each dye bypass conduit 46. In the undesirable event that a solid contaminant lodges itself at the entrance to a dye conduit formed by dye groove 19, thus restricting dye flow through that dye conduit, it can easily be pushed away from the dye conduit entrance and out of the supply stream and into the bypass stream by inserting a properly sized wire into the conduit from the orifice 20. The solid contaminant would then exit the trough 16 by way of bypass conduit 46, through the dye return fittings 47 and into the recirculation system 48 where it will be removed through filtration.

Additional information relating to the operation of such a spraying apparatus, including more detailed description of patterning and control functions, can be found in coassigned U.S. Pat. No. 4,923,743, which is incorporated by reference as if fully set forth herein.

Variations in dye delivery onto a substrate using the module of the present invention (as shown in FIGS. 1 through 4A) and an array of separately manufactured and assembled components, as previously described and disclosed in coassigned U.S. Pat. No. 4,923,743, were compared. The maximum misalignment of the dye and air orifices in the latter apparatus was found to be 0.007 inch. The dye orifices in that apparatus were spaced 0.400 inch from each other and during dyeing the substrate was located 3.8 inches from the dye orifice. The relative angle between the air and dye streams is 26 degrees. Because of misdirectivity in the dye flow this angle varied from 22.5 to 29.5 degrees. This difference in relative angle varies the length of the dye stream in the diverging air stream. More specifically, the dye path length is 0.37 inches and 0.68 inches for the angles of 29.5 degrees and 22.5 degrees respectively. The length of dye stream in the air stream is atomized and deposited on the substrate. Because of the varying lengths of the dye stream in the air stream, a varying amount of dye is atomized and deposited on the substrate. This creates a visually obvious streak in the dye pattern.

In contrast, in a module of the present invention as described above, the relative angle between the air and dye stream is within the range of 25.5–26.5 degrees. The dye stream lengths in the air stream are 0.458 inches and 0.499 inches for angles of 25.5 degrees and 26.5 degrees, respectively. Additionally, the maximum misalignment of the dye and air orifices is 0.001 inch.

Due to the minimal amount of dye stream length variation and misalignment, the present invention provides means for producing very precise and uniform spray pattern applications. The module configuration of the present invention is also non-adjustable and tamper proof, thereby providing an added advantage for extended commercial production. The efficiency of dye deposition on the substrate is also improved by the configuration of the present invention, wherein the dye orifice is not in the air stream. As shown in FIG. 4, the dye orifice is positioned substantially outside the air stream envelope. This configuration maximizes the dye stream length that is positioned within the air stream envelope, and thereby atomized and carried by the air stream to the substrate.

The above describes one preferred embodiment of the invention. A second preferred embodiment is shown in FIGS. 5 through 8. As many of the elements constituting this second embodiment are similar or identical to those discussed above, the entire apparatus will not be described. Rather, the focus will be on those elements which are different from or added to the apparatus described above.

Unlike the multi-piece system described in connection with FIGS. 1 through 4A, the second embodiment is comprised of a single piece body 111 which does not require the additional lower plate 31. Rather, the single piece body 111 has air passages 133 bored therethrough as can be more clearly shown in FIG. 7. Air supply channels 133 are connected to air orifices 123 at one end and air fittings 134 at the other end, for connection to air hose or line 152, asshown in FIG. 5.

Figure 6:
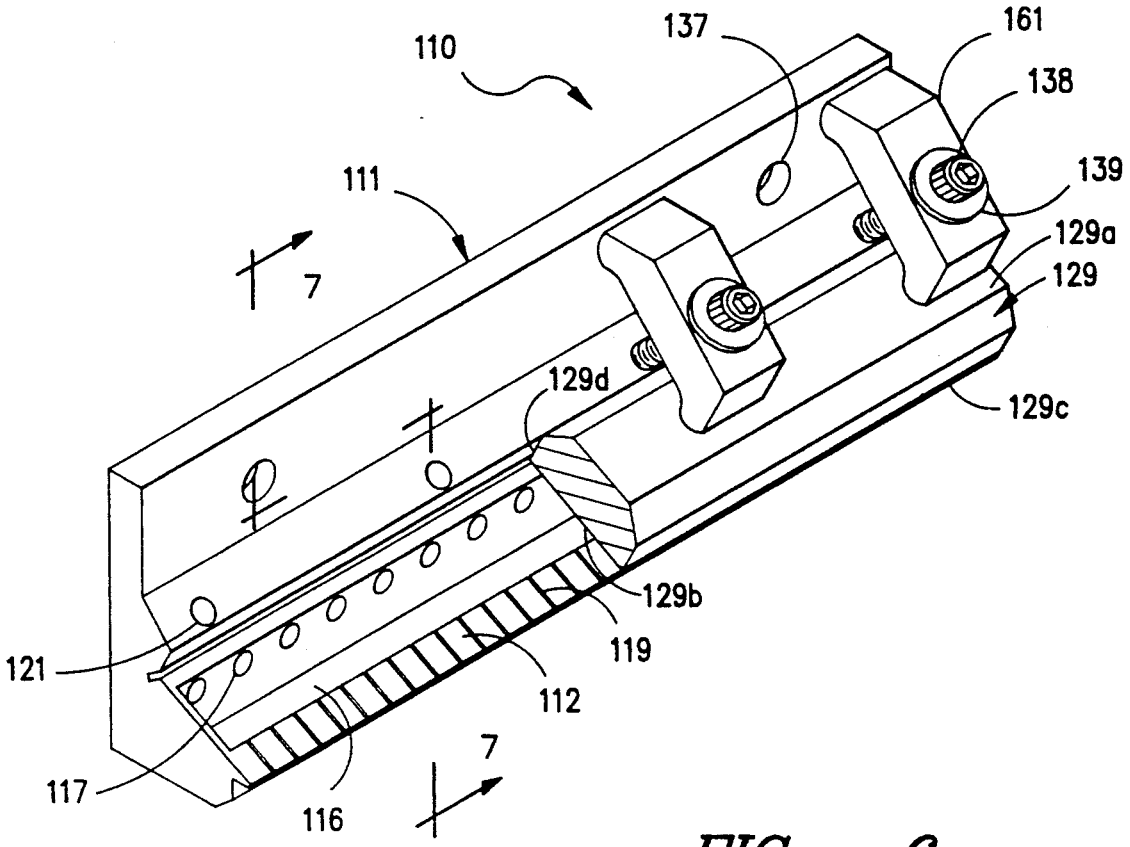
FIG. 6 depicts the embodiment of FIG. 5 in a perspective view in partial section, as viewed from above.

With regard to the dye delivery system, a dye channel or trough 116, similar to trough 16 in the first embodiment, is formed in body 111 as shown. Trough 116 communicates with a number of dye conduits 117, as can be seen in FIG. 6, along the rear wall of trough 116. Dye conduits 117 are in fluid communication with dye fittings 118 that communicate with the rear wall 115 of the module 110. Threaded fittings 118 provides a means for connecting the dye conduits 117 to external dye conduits 150, which in turn are connected to the dye supply manifold 142 as shown in FIG. 5.

Upper planar surface 112 of body 111 has a number of dye grooves 119 which extend from trough 116 to dye orifices 120 on the front surface 113 of body 111, forming a path for dye flow through 116 to dye orifice 120. Dye grooves 119 are longitudinally spaced along the body 111 at intervals of about 0.200 inch, with each groove having the same predetermined uniform cross-sectional area.

Unlike the earlier embodiment, however, the dye bypass conduit 146 extends from the trough 116 to the bottom surface 131 of body 111 and is fitted with dye return fittings 147 for connection to a dye recirculation system 48.

Air orifices 123 are longitudinally spaced along body 111 at intervals of about 0.200 inch, with each air orifice 123 being paired with a corresponding dye groove 119 with both the groove 119 and the air orifice 123 lying in the same plane. Each air orifice 123 is drilled and reamed to a constant radius of curvature throughout its length of about 0.011 inches. Each air orifice 123 is in communication with air supply channel 133. Fitting 134 joins air line 152 to bore 133 As can be seen in FIGS. **4*a* and 7*a*, the planar front surfaces 113 and 125 of body 111 are arranged identically as shown with regard to the first embodiment with corresponding surfaces 13 and 25**.

The upper cover plate 129 is a block of stainless steel with its planar upper, lower, front, back and side surfaces **129*a*, 129*b*, 129*c*, 129*d* and 129*e*. Mounting surface 135 corresponds to surface 35*c* of the first embodiment. Unlike the first embodiment, rather than having bolt holes extend directly through the upper cover plate, a series of clamps 161 are arranged which interact with mounting surface 135. The module 110 is assembled by placing lower surface 129*b* of upper cover plate 129 on planar surface 112 of body 111 such that the side surfaces 129*e* of the upper cover plate are flush with the side surfaces of body 111 and such that the front surface 129*c* of upper cover plate 129 is flush with front surface 113. Threaded bolts 138 are then placed through the clearance holes 130 in the clamps 161 and are threaded into the upper fastening holes 121. Bolts 138 are tightened to cause clamps 161 to produce a liquid tight seal between the upper cover plate 129 and upper surface 112 of body 111**.

The operation of this embodiment is similar to that described above with respect to the first embodiment except for the bypass conduit 146, which in this embodiment has a path perpendicular to that of the inlet conduit 117 for the dye, as can be seen in FIGS. 5, 7, and 8.

From the foregoing, it will be apparent to those skilled in the art that various modifications in the above described devices can be made without departing from the spirit and scope of the invention. Accordingly the invention may be embodied in other specific forms without departing from the spirit or essential characteristics thereof. Present embodiments, therefore, are to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An apparatus for spraying a liquid marking material onto the surface of a substrate utilizing a source of pressurized control fluid and a source of liquid marking material, said apparatus comprising:

(a) a block of rigid material having a plurality of first conduits for delivery of said marking material and a plurality of second conduits for delivery of said pressurized control fluid;

(b) each of said first conduits having an inlet and an outlet for said liquid marking material;

(c) each of said second conduits having an inlet and an outlet for said pressurized control fluid;

(d) said inlet of each of said first conduits arranged for connection to said source of marking material;

(e) said inlet of each of said second conduits arranged for connection to said source of control fluid;

(f) said outlets of said second conduits arranged adjacent to corresponding outlets of said first conduits and cooperating to effect division of a stream of said marking material exiting said outlets of said first conduits into droplets by an impinging stream of said pressurized control fluid exiting said outlets of said second conduits; and (g) a means for nonaspiratively positioning said outlets of said first conduits outside said stream of said pressurized control fluid.

2. The apparatus according to claim 1 wherein said first and second conduits are formed at least in part from corresponding first and second grooves formed in said block.

3. The apparatus according to claim 2 wherein said conduits further comprise: first closure means for enclosing said first grooves to form said first conduits; and second closure means for enclosing said second grooves to form said second conduits.

4. The apparatus of claim 3 wherein said first closure means is a first plate abutting said module body such that said first grooves are enclosed.

5. The apparatus of claim 4 wherein said second closure means is a second plate abutting said module body such that said second grooves are enclosed.

6. The apparatus of claim 5 wherein said second plate of said second closure means comprises a surface for abutting said module body and a plurality of air supply channels extending through said plate with inlets for connection to pressurized air and outlets for connection to said inlets of said second grooves.

7. The apparatus according to claim 1 wherein at least one of said first and second conduits includes passages formed completely by the surfaces of said block and extending through said block.

8. The apparatus according to claim 1 wherein said second conduits include passages bored through said rigid material.

9. The apparatus according to claim 8 wherein said first conduits includes grooves formed in said block and said second conduits include passages through said block.

10. The apparatus according to claim 9 wherein said conduits further comprise: first closure means for enclosing said first grooves to form said first conduits.

11. The apparatus of claim 10 wherein said first closure means is a first plate abutting said module body such that said first grooves are enclosed.

12. An apparatus for spraying a liquid marking material onto the surface of a substrate by nonaspiratively dividing a stream of said marking material into droplets by an impinging stream of pressurized control fluid directed at said surface, said apparatus comprising:

a rigid module body having a plurality of first grooves, a plurality of second grooves, and a trough having a means for removing possible contaminants in said marking material;

an upper cover plate abutting said module body such that a surface of said upper plate encloses said first grooves so as to form a plurality of first conduits for delivery of said marking material, said first conduits having one end in communication with said trough and another end extending to the outside of said module body and forming a marking material orifice;

a lower cover plate abutting said module body such that a surface of said lower cover plate encloses said second grooves to form a plurality of second conduits for delivery of said impinging stream of said control fluid, said lower cover plate forming a control fluid supply channel, said second conduits being in communication with said control fluid supply channel and having one end extending to the outside of said module body and forming a control fluid orifice; and a means for nonaspiratively positioning said marking material orifice outside said stream of pressurized control fluid.

13. The apparatus of claim 12 further comprising:

a first pressurized source for delivering said marking material into said trough such that said marking material continuously flows out of said trough, through said first conduits and out of said module body through said marking material orifices; and a second pressurized source for delivering said control fluid into said control fluid supply channel such that said control fluid flows out of said control fluid supply channel, through said second conduits, and out of said module body through said control fluid orifices.

14. An apparatus for spraying a liquid marking material onto the surface of a substrate by dividing a stream of said marking material into droplets by an impinging stream of pressurized control fluid directed at said surface, said apparatus comprising a module forming a plurality of first conduits for delivery of said stream of said marking material through a marking material orifice and a plurality of second conduits for delivery of said impinging stream of said control fluid nonaspiratively, wherein each of said first conduits are permanently positioned with respect to any other neighboring first conduit and a means for nonaspiratively positioning said marking material orifice outside said stream of pressurized control fluid.

15. The apparatus of claim 14 wherein each of said first conduits is permanently positioned with respect to each other of said first conduits.

16. The apparatus of claim 15 wherein each of said first conduits is also permanently positioned with respect to each of said second conduits.

17. An apparatus for spraying a liquid marking material onto the surface of a substrate by nonaspiratively dividing a stream of said marking material into droplets by an impinging stream of pressurized control fluid directed at said surface, said apparatus comprising:

a module forming a plurality of first conduits for delivery of said stream of said marking material and a plurality of second conduits for delivery of said impinging stream of said control fluid, wherein said module comprises:

a wedge shaped body having an upper planar surface, a lower planar surface, a front surface and a back surface; a trough having a means for removing possible contaminants in said marking material;

a plurality of first grooves longitudinally spaced along said upper planar surface of said body each with one end in communication with said trough and one end forming a marking material orifice; another plurality of second grooves longitudinally spaced along said lower planar surface of said body; and at least one marking material supply conduit extending from said back surface of said body into said trough;

an upper cover plate adapted for attachment to said upper planar surface of said body such that the lower surface of said upper cover plate encloses said first grooves forming said first conduits;

a lower cover plate having a plurality of control fluid supply channels each extending from the back surface of said lower cover plate and ending in an opening on the upper surface of said lower cover plate; said lower cover plate being adapted for attachment to said lower planar surface of said body such that said upper surface of said lower cover plate encloses said second grooves to form said second conduits and such that said openings on said upper surface of said lower cover plate are aligned with said second grooves; and a means for nonaspiratively positioning said marking material orifice outside said stream of pressurized control fluid.

18. The apparatus of claim 17 further comprising:

a first pressurized source for delivering said marking material into said trough such that said marking flows out of said trough, through said first conduits and out of said module body through said marking material orifices; and a second pressurized source for delivering said control fluid into said control fluid supply channel such that said control fluid flows continuously out of said control fluid supply channel, through said second conduits, and out of said module body through said control fluid orifices.

19. The apparatus of claim 13 or 18 further comprising control means for regulating flow of air from said second pressurized source to said control fluid supply channels in accordance with dye pattern information.

20. An apparatus for spraying a liquid marking material onto the surface of a substrate by nonaspiratively dividing a stream of said marking material into droplets by an impinging stream of pressurized control fluid directed at said surface, said apparatus comprising:

a rigid module body having a plurality of first grooves, a plurality of passages, and a trough for having a means for removing possible contaminants in said marking material;

an upper cover plate abutting said module body such that a surface of said upper plate encloses said first grooves so as to form a plurality of first conduits for delivery of said marking material, said first conduits having one end in communication with said trough and another end extending to the outside of said module body and forming a marking material orifice;

said plurality of passages formed completely by internal surfaces of said block for delivery of said impinging stream of said control fluid, said second passages having one end extending to the outside of said module body and forming a control fluid orifice; and a means for nonaspiratively positioning said marking material orifice outside said stream of pressurized control fluid.

21. The apparatus of claim 20 further comprising:

a first pressurized source for delivering said marking material into said trough such that said marking material flows out of said trough, through said first conduits and out of said module body through said marking material orifices; and a second pressurized source for delivering said control fluid into said passages such that said control fluid flows out of said passages and out of said module body through said control fluid orifices.

22. An apparatus for spraying a liquid marking material onto the surface of a substrate by nonaspiratively dividing a stream of said marking material into droplets by an impinging stream of pressurize control fluid directed at said surface, said apparatus comprising:

a module forming a plurality of first conduits for delivery of said stream of said marking material and a plurality of second conduits for delivery of said impinging stream of said control fluid, wherein said module comprises:

a wedge shaped body having an upper planar surface, a front surface and a back surface; a trough having a means for removing possible contaminants in said marking material; a plurality of first grooves longitudinally spaced along said upper planar surface of said body each with one end in communication with said trough and one end forming a marking material orifice; a plurality of passages longitudinally spaced in said body; and at least one marking material supply conduit extending from said back surface of said back into said trough;

an upper cover plate adapted for attachment to said upper planar surface of said body such that the lower surface of said upper cover plate encloses said first grooves forming said first conduits;

said passages including a fluid supply channel and a fluid delivery channel, said fluid supply channel being in fluid communication with said delivery channel and having a longer effective length than said delivery channel, and said delivery channels being aligned with said grooves; and a means for nonaspiratively positioning said marking material orifice outside said stream of pressurized control fluid.

23. The apparatus of claim 22 further comprising:

a first pressurized source for continuously delivering said marking material into said trough such that said marking material flows out of said trough, through said first conduits and out of said module body through said marking material orifices; and a second pressurized source for delivering said control fluid into said control fluid supply channel such that said control fluid flows out of said control fluid supply channel, through said delivery channel, and out of said module body through said control fluid orifices.

24. The apparatus of claim 21 or 23 further comprising control means for regulating flow of air from said second pressurized source to said control fluid supply channels in accordance with dye pattern information.

25. An apparatus for spraying liquid marking material onto the surface of a substrate nonaspiratively utilizing a source of pressurized control fluid and source of liquid marking material, said apparatus comprising:

(a) a block of rigid material having a plurality of first conduits for delivery of said marking material and a plurality of second conduits for delivering of said pressurized control fluids, and a plurality of third conduits for delivery of unused marking material away from said modules for removal of possible contaminants in said marking material;

(b) each of said first and third conduits having an inlet and an outlet for said liquid marking material;

(c) each of said second conduits having an inlet and an outlet for said pressurized control fluids;

(d) said inlet of said first conduits arranged for connection to said source of marking material;

(e) said inlet of each second conduits arranged for connection to said source of control fluids;

(f) said inlet of said third conduit arranged to communicate with marking material that has not passed through said outlets of said conduits;

(g) said outlets of said second conduits arranged adjacent to corresponding outlets of said first conduits and cooperating to effect division of a stream of marking material exiting said outlets of said first conduits into droplets by an impinging stream of said pressurized control fluid exiting said outlets of said second conduits; and (h) a means for nonaspiratively positioning said outlets of said first conduits outside said stream of pressurized control fluid.

26. The apparatus according to claim 25 wherein said module comprises a trough, said first conduits having one end in communication with said trough and another end extending to the outside of said module body and forming a marking material orifice, said third conduits having one end in communication with said trough displaced from said first conduits and another end extending outside of said module body for delivering unused marking material away from said module.

27. The apparatus according to claim 26 wherein said trough defines a bottom and said inlets of said third conduits being in communication with said trough through said bottom and said outlet extending to the outside of said module for delivering unused marking material away from said module.

28. The apparatus according to claim 26 wherein said trough includes a rear wall; said third conduits include inlets in communication with said trough through said rear wall and outlets extending to the outside of said module body for delivering unused marking material away from said module.

29. The apparatus according to claim 26, 27 or 28 further comprising means for directing marking material under pressure to said first conduits.

30. The apparatus according to claim 29 further comprising means for recirculating marking material that has not passed through said first outlets or said marking material, that has not been sprayed onto fabric to said means for directing marking material under pressure.

* * * * *